US005794600A

United States Patent [19]

Hill

[11] Patent Number: 5,794,600

[45] Date of Patent: Aug. 18, 1998

[54] INTERNAL COMBUSTION ENGINE CONTROL

[75] Inventor: Raymond John Hill, Beldon, Australia

[73] Assignee: Orbital Engine Company (Australia) Pty. Limited, Balcatta, W.A., Australia

[21] Appl. No.: 750,971

[22] PCT Filed: Jun. 29, 1995

[86] PCT No.: PCT/AU95/00390

§ 371 Date: Dec. 27, 1996

§ 102(e) Date: Dec. 27, 1996

[87] PCT Pub. No.: WO96/00843

PCT Pub. Date: Jan. 19, 1996

[30] Foreign Application Priority Data

Jun. 30, 1994 [AU] Australia ..... PM 6565

[51] Int. Cl.[6] ..... F02D 1/06

[52] U.S. Cl. ..... 123/531; 123/533

[58] Field of Search ..... 123/531, 533, 123/406

[56] References Cited

U.S. PATENT DOCUMENTS

| | | | |
|---|---|---|---|
| 4,446,833 | 5/1984 | Matsushita et al. | 123/435 |
| 4,541,381 | 9/1985 | Sugiura | 123/406 |
| 4,754,735 | 7/1988 | Simons | 123/533 |
| 4,936,279 | 6/1990 | Ragg | 123/533 |
| 4,944,272 | 7/1990 | Carlsson et al. | 123/438 |

FOREIGN PATENT DOCUMENTS

27713/71 6/1971 Australia .

2 160 263 12/1985 United Kingdom .

OTHER PUBLICATIONS

Patent Abstracts of Japan, p. 75, JP 63–205430, 24 Aug. 1988.

Patent Abstracts of Japan, p. 132, JP 55–137326, 27 Oct 1980.

Patent Abstracts of Japan, p. 100, JP 65–7917, 21 Jan. 1980.

*Primary Examiner*—Tony M. Argenbright
*Assistant Examiner*—Hieu T. Vo
*Attorney, Agent, or Firm*—Nikaido, Marmelstein, Murray & Oram LLP

[57] ABSTRACT

A method of controlling operation of an internal combustion engine over part of the load or speed operational range of the engine by the use of fluid pressure available from a source associated with the operation of the engine to effect a managed control of at least one operating parameter of the engine such as engine speed or fuel delivery including fuelling rate and timing, or ignition timing. The gas pressure is preferably derived from a source where the pressure varies in relation to variations in the engine speed and/or load or from a substantially steady pressure source, applied in a selective manner to effect the control. Preferably, the fluid pressure is a gas pressure derived from the operation of the engine. For example, the gas pressure may be derived from the gas in the crankcase of a two stroke cycle crankcase scavenged engine or from another source where the pressure of the gas is cyclic in a known waveform and provision is made to selectively apply the high and/or low portion of the pressure wave to the control device to effect the control of the engine operation.

28 Claims, 6 Drawing Sheets

INTERNAL COMBUSTION ENGINE CONTROL

This invention relates to the control of the operation of an internal combustion engine and in particular to the control of the speed and/or load of an internal combustion engine.

In the control of the operation of an engine there are a number of control functions that necessitate movement of components to vary an aspect of the engine operation. It is currently a common practice to use electrically or electronically operated devices to effect such movements, the devices usually being operable in response to sensed engine operating conditions. The devices may be directly controlled by the sensed inputs, or said sensed inputs may be fed into an electronic control unit (ECU) which in turn controls such devices. These known practices are effective and accurate, however the electrical or electronic devices typically used are relatively expensive to construct or purchase and require a significant source of electrical energy. These cost factors are particularly relevant in respect of low cost small capacity engines.

With the increasing requirement to reduce the emissions of internal combustion engines, it has been recognised that controls must be introduced in respect of the permitted level of exhaust emissions from a range of engines in addition to automotive engines, and particularly in regard to small capacity engines such as marine engines for pleasure craft and engines for motorcycles and motor scooters. There are also trends towards restrictions on fuel consumption and emissions from various forms of stationary internal combustion engines and equipment employing relatively low cost, small capacity internal combustion engines such as lawnmowers and chainsaws.

It has been established that the most effective control of exhaust emissions, particularly in two stroke cycle engines, is attained by directly injecting the fuel into the engine combustion chambers. In automobiles having relatively large capacity engines, it is economically acceptable to provide a sophisticated engine management system incorporating a high capacity electronic control unit (ECU) programmed to control all aspects of the combustion process including fuel metering, fuel injection and ignition. However, the costs of such engine management systems are too high to permit the use thereof in controlling the operation of relatively low cost small capacity engines such as small marine engines, motorcycle and scooter engines and lawnmower engines.

An area of operation of such small capacity engines that presents challenges in the management of the delivered fuelling rate, and hence exhaust emissions, is operation at engine idle speed due to the fact that the quantity of fuel required by each engine cylinder is relatively small and must be able to be accurately controlled. Previously, attaining the required fuelling rate control at idle has required the use of electrical componentry such as a linear stepper motor controlled by an electronic control unit (ECU). This equipment is expensive relative to the total fuel system cost and the use thereof is therefore undesirable, although necessary in some applications to achieve the required level of speed control. Further, the durability of stepper motors in long term use has been found to be less than the desired level in some environments, and other issues such as vibration problems and reliability are often associated therewith.

It is therefore the object of the present invention to provide a method and apparatus for use in the control of the operation of an internal combustion engine which is effective and reliable in operation and is relatively low cost to operate and incorporate into an engine control system.

There is thus provided a method of operating an internal combustion engine having a fuel injection system to inject fuel entrained in a compressed gas to the engine combustion chamber, said method comprising, in at least part of the operating range of the engine, managing fluid pressure available from a source associated with the operation of the engine, and applying said managed pressure to power a mechanism which controls at least one operating parameter of the engine, the control of said mechanism being effected by an electronic control unit.

Typical parameters of the engine that can be controlled by the use of the fluid pressure are engine speed, fuel delivery including fuelling rate and timing, and ignition timing.

Preferably, the fluid pressure is a gas pressure derived from the operation of the engine. For example, the gas pressure may be derived from the gas in the engine crankcase of a two stroke cycle crankcase scavenged engine or from the air or gas source of a two fluid fuel injection system wherein compressed air, gas, typically being used to effect injection of the fuel.

Alternatively, the gas pressure available from the engine induction system or the engine exhaust system can be used to provide the energy to effect the control of the operating parameter of the engine. If the engine is equipped with a compressor to provide compressed gas to perform a specific function during engine operation, the pressure of the gas on the intake or delivery side of the compressor can be used to effect said control. Such a compressor can be provided for the purpose of providing a compressed gas, conveniently air, to effect delivery of fuel to the respective combustion chambers of the engine by way of a two fluid fuel injection system as mentioned hereinbefore.

In one preferred form of the invention, there is provided a method of operating an internal combustion engine over at least part of the operational load and/or speed range of the engine comprising applying gas pressure derived from the operation of the engine to actuate a control means to control at least one operating parameter of the engine.

Conveniently, the gas pressure is derived from a source where the pressure varies in relation to variations in the engine speed and/or load. Alternatively, the gas pressure can be derived from a substantially steady pressure source, and applied in a selective manner to actuate a control means to achieve variation in respective opposite or multiple directions of an actuator thereof to control at least one parameter of the engine operation.

In one arrangement, the pressure of the gas is cyclic in a known waveform and provision is made to selectively apply the high and/or low portion of the pressure wave activate to the control means to effect the control of the engine parameter. Such a source of cyclic pressure is available, as mentioned hereinbefore, from the crankcase of a crankcase scavenged two stroke cycle internal combustion engine.

In one specific form, the invention is applied to the control of the supply of fuel to the respective cylinders of an internal combustion engine, particularly a two stroke cycle internal combustion engine. More specifically, there is provided a method of controlling the speed of an internal combustion engine wherein at least when the engine is operating in a selected speed range, the fuelling rate is controlled by physical movement of a fuel control member, said method comprising effecting said physical movement of the fuel control member by a force generated by a gas pressure derived from the operation of the engine, said gas pressure being varied in response to engine speed.

Conveniently, said gas pressure generated force is applied to effect movement of the fuel control member, or of an intermediate member or members that effect movement of the fuel control member. Preferably, the force is generated by applying the gas pressure to a working means such as a piston or diaphragm that is linearly displaceable and is coupled to the fuel control member. This form of control of the fuelling rate is preferably exercised at least when the engine is at or near idle speed.

Conveniently, the fuel is delivered to the engine entrained in a compressed gas, and the same source of gas pressure can be used to effect the movement of the fuel control member.

More specifically, there is provided a method of controlling the speed of a fuel injected internal combustion engine, wherein the fuel is injected entrained in a gas and, at least when the engine is idling, or operating in a selected speed range, the fuelling rate is controlled by the physical movement of a fuel control member, said method comprising effecting said movement of said fuel control member by a force generated in response to the pressure of said gas.

Preferably, the selected speed range is a range including the normal idle speed of the engine, or may be another speed range where there is normally a restricted variation in operating speed. Preferably, another form of actuation to control the fuelling rate for the engine is provided for use when the engine is operating outside the selected speed range, and said another form of actuation can operate alone or in combination with the fuel control member referred to above.

Conveniently, the pressure of the gas used to inject the fuel is varied in response to changes in engine speed, particularly at idle operation. In a preferred form, the gas for use in injection of the fuel is held in a reservoir and supplied thereto from the combustion chamber of one or more combustion chambers of the engine as they are undergoing a compression stroke. The variation of the gas pressure in the reservoir can thus be achieved by adjustment of the termination point of the supply of air from the combustion chamber to the reservoir relative to the engine cycle of that combustion chamber. Typically, the closer the termination point to the top dead centre location of the piston in the compression stroke, the higher the pressure of the gas delivered to and ultimately retained in the reservoir.

In engines where fuel is injected entrained in a gas directly into the combustion chamber, the supply of gas or air from the combustion chamber to the reservoir can be effected through the injector by maintaining the injector open for a period after completion of the injection of the fuel. Upon the compression pressure in the combustion chamber rising above the pressure in the reservoir, gas will be delivered into the reservoir causing a resultant pressure rise therein. Thus, the pressure of the gas in the reservoir can be varied by adjusting the timing of the closing of the injector. However, other aspects of the injector operation can also influence the pressure of the gas in the reservoir when the engine is operating. These other factors include, but are not limited to, the following factors which have an influence either independently or collectively:

(1) Start of injection.

(2) Duration of injection.

(3) Frequency of injection.

(4) Stroke of injector valve.

A typical arrangement of a gas reservoir and injector valve suitable or use in this manner is disclosed in more detail in one form in the applicant's U.S. Pat. No. 4,936,279 and in another form in the applicant's PCT Patent Application No. PCT/AU94/00210, and the disclosures therein are hereby incorporated into this specification by reference.

The pressure of the gas as established in the reservoir in this manner can be used to effect the required movement of the fuel control member.

In another specific form of the invention, there is provided a method of controlling the speed of an internally or crankcase scavenged two stroke cycle engine, wherein at least when the engine is idling, or operating in a selected speed range, the fuelling rate is controlled by physical movement of a fuel control member, said method comprising effecting said movement of said fuel control member by a force generated in response to the crankcase pressure of said engine.

By way of a switching means which controls the timing and duration of the crankcase pressure generated force as applied to the fuel control member, the physical movement thereof can be controlled. Further, both the positive pressure component and the negative pressure component of the crankcase pressure, or a combination thereof, may be used to generate the force to cause the movement of the fuel control member.

Alternatively, the gas pressure generated force to effect movement of the fuel control member may be derived from the air induction system of the engine. The varying nature of the induction system air pressure in relation to variations in the engine speed and/or load may be used to directly actuate the fuel control member, or alternatively, the induction system gas pressure can simply be used as a source of control pressure for the fuel control member. In this latter arrangement, a switching means as described hereinbefore could be used to control the timing and duration of the pressure generated force as supplied to the fuel control member.

Conveniently, the gas pressure derived from any of the above mentioned sources can be applied to a displaceable member such as a piston or diaphragm located within or forming part of a chamber, whereby the degree of displacement of the member is determined by the pressure of the gas in a part of the chamber. The displaceable member is connected directly or indirectly to the fuel control member to control the quantity of fuel delivered to the engine in response to the pressure of the gas in the or a part of the chamber.

Preferably, the fuel control member is arranged such that an increase in the gas pressure generated force results in a decrease of the fuelling rate to the engine and vice versa. Alternatively, the fuel control member may be arranged such that a decrease in the gas pressure generated force results in an increase of the fuelling rate to the engine and vice versa.

It is preferred that the quantity of gas held in the chamber or a part thereof is selected in relation to the required fuelling rate in contrast to the pressure of the gas. Appropriate valving is provided to control the supply and release of gas from the or a section of the chamber in accordance with the required fuelling rate.

In summary, the control of the operation of a selected functional aspect of an engine, such as the fuel supply rate, over at least a selected range of engine operation, is achieved indirectly by use of an available source of gas pressure, preferably available from the engine during normal operation, thus not requiring the provision of an additional or dedicated pressure source. The gas source can be applied in a simple on/off mode to operate the control or may modulate the pressure or duration of application thereof in exercising the control.

Also, the reference to pressure herein, in relation to the gas used to effect the control of the engine, is to absolute pressure and thus include sub-atmospheric pressure (vacuum).

The invention will be more readily understood from the following description of several practical arrangements of the engine fuelling rate control system as currently proposed.

In the drawings.

Figure 1:
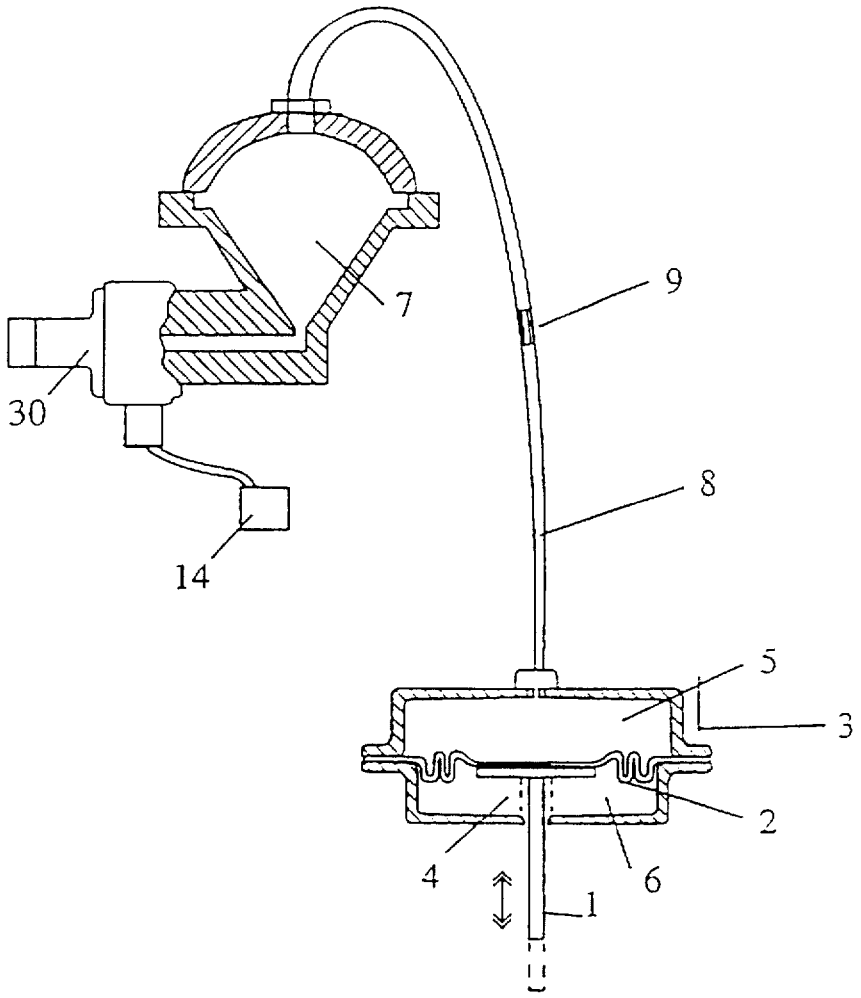
FIG. 1 is a schematic representation of one embodiment of the present invention for controlling the engine speed of an internal combustion engine.

Referring now to FIG. 1 of the drawings, there is illustrated therein diagrammatically the basic layout of an engine speed control mechanism particularly adapted for use in controlling the engine speed at idle. The rod 1 is directly coupled at one end to the diaphragm 2 of the pressure actuator 3. The other end of the rod 1 is directly or indirectly connected to a member (not shown) which is part of a mechanism that controls the rate of supply of fuel to the engine in response to movement thereof induced by the movement of the rod 1. The fuel supply rate control apparatus will be described in further detail hereinafter. The pressure actuator 3 is of a conventional diaphragm type with the diaphragm 2 forming a pressure chamber 5 and having a compression spring 4 acting on the side of the diaphragm 2 opposite to the pressure chamber 5.

Figure 2:
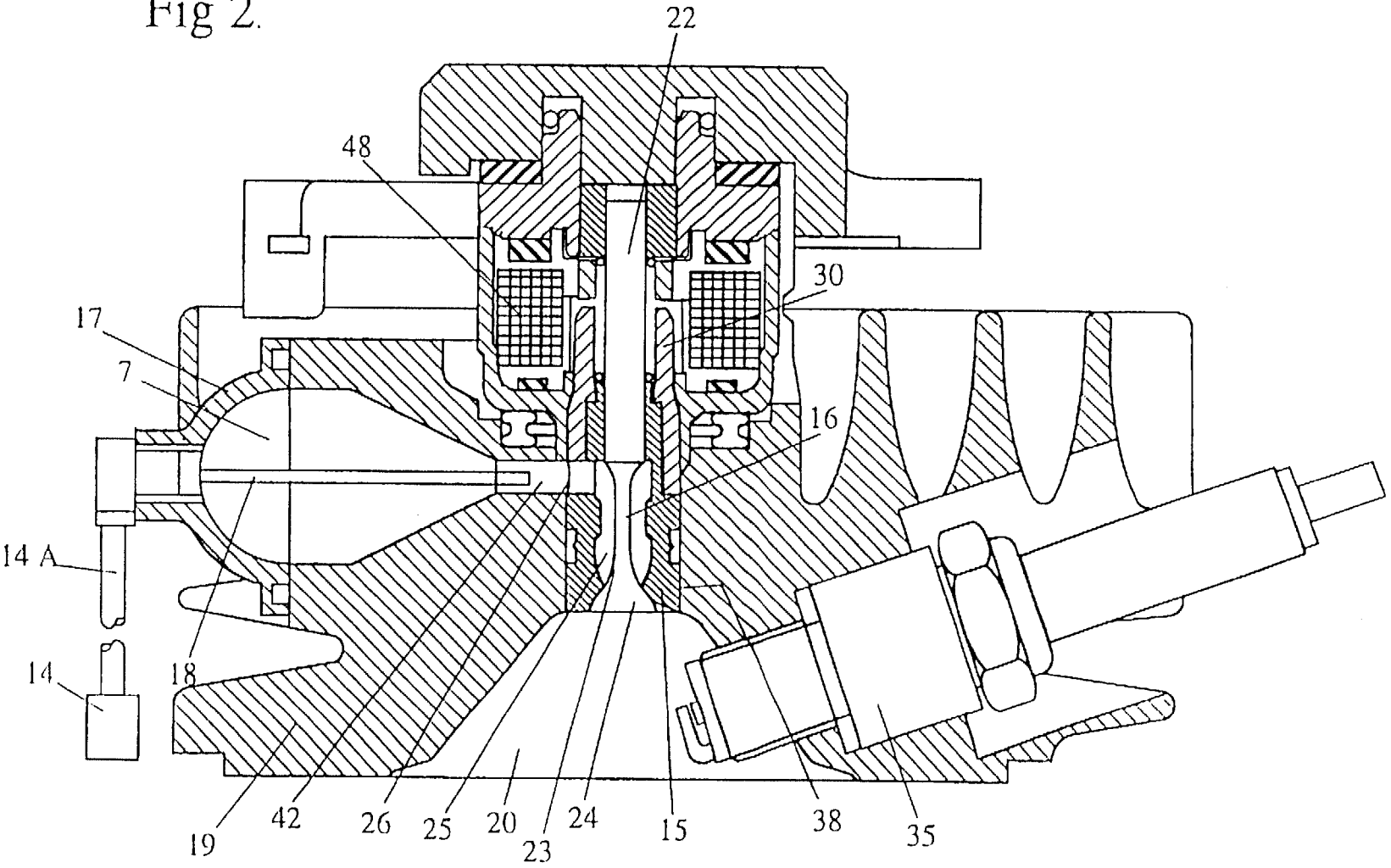
FIG. 2 is a part-sectional view of an engine cylinder head incorporating a fuel injector to which the speed control system of FIG. 1 may be applied.

The air reservoir 7 of a fuel injection system of the engine, such as is shown in FIG. 2, is in direct communication with the pressure chamber 5 of the pressure actuator 3 via the conduit 8 which incorporates an orifice 9 to restrict high frequency fluctuations in the pressure of the gas in the reservoir 7 from effecting the pressure of the gas in the pressure chamber 5. It is however to be noted that the conduit 8 could equally be in direct communication with the second pressure chamber 6. Although not shown, it is typical that the respective pressure chamber opposite that pressure chamber connected to the conduit 8 (eg: pressure chamber 6 in FIG. 1) will typically be vented to atmosphere to enable this pressure chamber to react to the corresponding increase or decrease in pressure in the other pressure chamber (eg: pressure chamber 5 in FIG. 1).

The injector nozzle unit 30 is fitted to the cylinder head of an engine in a known manner to inject fuel directly into the combustion chamber of one cylinder of the engine. The opening and closing of the injector nozzle is controlled by an electronic control unit (ECU) of known construction in a known manner to control the timing of the commencement and duration of the delivery of the fuel to the engine.

When the nozzle of the nozzle unit 30 is opened, air is discharged from the reservoir 7 through the nozzle with a metered quantity of fuel to assist in the atomisation and entrainment of the fuel. Subsequent to the delivery of the total metered quantity of fuel to the combustion chamber, the nozzle is held open for an additional period so that gas from the combustion chamber can be delivered into the reservoir 7 to replenish the gas supply therein and to raise the pressure of the gas to the necessary level to effect the next fuel delivery event. This concept of supplying compressed air for the injection system is disclosed in detail in the applicant's U.S. Pat. No. 4,936,279 and in the applicant's previously referred to PCT Patent Application No. PCT/AU94/00210. The disclosure in each of these specifications is incorporated herein by reference.

The nominal pressure of the gas or air in the reservoir 7 is determined by the timing of the opening and more importantly the closing of the injector nozzle relative to the position of the piston in the combustion chamber on the compression stroke of the combustion cycle. Typically, the later the closing of the injector nozzle in the compression stroke, the higher the pressure of the gas in the reservoir 7. Accordingly, if the engine speed varies from the nominated speed, such as the nominated idle speed of the engine, then by varying the timing of the opening and/or closing of the injector nozzle, the pressure in the reservoir 7 can be increased or decreased. This in turn will cause the diaphragm 2 to either extend or withdraw the rod 1 from its current position as a consequence of an increase or decrease of the pressure in the pressure chamber 5. That movement of the rod 1 will adjust the fuelling rate to the injector unit 30 (ie: metered quantity of fuel delivered thereto) to return the engine speed to the preset or desired value as hereinafter described.

In general, the pressure in the reservoir 7 is more sensitive to the closing of the injector nozzle and accordingly, control of the timing of injector nozzle closure is more significant. However, other aspects of the injector nozzle operation can also influence the pressure of the gas in the reservoir 7 when the engine is operating. Accordingly, these influencing factors include, but are not limited to, the following either independently or collectively:

(1) Start of air injection.

(2) Duration of air injection.

(3) Frequency of air injection.

(4) Stroke of injector valve.

Thus, in one embodiment, if the engine speed decreases beyond the preset or desired value, the injector nozzle will be closed earlier in the compression stroke of the cylinder, thereby reducing the prevailing pressure in the reservoir 7 and the chamber 5, and hence, moving the rod 1 upwardly as seen in FIG. 1 which can be applied as hereinafter described to increase the fuelling rate to the engine. Conversely, if the engine speed increases beyond the preselected value, the timing of the closing of the injector nozzle will be adjusted to be later in the compression stroke, thereby increasing the pressure in the air reservoir 7 and chamber 5 and hence moving the rod 1 downwardly to decrease the fuelling rate to the engine. Obviously, the converse would apply if conduit 8 were connected to pressure chamber 6. The manner in which the engine fuelling rate is controlled by alternation of the stroke of a piston of a fuel metering apparatus will be described in further detail hereinafter.

The function of the orifice 9 in the conduit 8 is to dampen the effect of pressure fluctuations in the reservoir 7 which will occur each time the injector nozzle is opened. Hence, the diaphragm 2 in the pressure actuator 3 will not be significantly influenced by the pressure variations in the reservoir 7 within each cycle, but will primarily only be effected in response to longer term variations in the pressure in the reservoir 7.

Another source of variable pressure to drive the actuator 3 is the conventional throttle controlled air induction passage of the engine. As is well known, a sub-atmospheric pressure exists in the induction passage when the engine is operating and as the engine speed increases, for a set throttle position, the pressure in the induction passage decreases and vice versa. Accordingly, if the conduit 8 (as shown in FIG. 1) were in communication with the engine induction passage as an alternative to the gas reservoir 7, a source of speed related variable pressure would be available to the pressure chamber 6 on the opposite side of the diaphragm 2 to the pressure chamber 5 of the actuator 3. That is, the conduit 8 is required to communicate with the pressure chamber 6 and not the pressure chamber 5 due to the sub-atmospheric nature of the pressure source.

In such an arrangement, if the engine speed increases above a selected value, the pressure in the pressure chamber 6 will decrease (increased vacuum in induction passage) causing the diaphragm 2 to move downward, and if the speed decreases, the diaphragm 2 will move upwards. Accordingly, the fuelling rate to the engine is controlled by the movement of the rod 1 to maintain the engine speed at a preselected speed, specifically, a predetermined idle speed. It will be realised that in this modification, the spring 4 will be a tension spring or alternatively may be arranged to be located on the other side of the diaphragm 2 with the vent to atmosphere.

The arrangement of the injector nozzle unit 30 and air reservoir 7 as shown diagrammatically in FIG. 1 are shown in further detail in FIG. 2, wherein the air reservoir 7 is incorporated into the head of the cylinder of a two stroke cycle engine in which there is also incorporated a two fluid fuel injector unit 30 and a spark plug 35. From a consideration of FIG. 2 and the following description, it is evident that some existing engine hardware is used to control engine speed.

The two fluid fuel injector 30 is of known construction and is located in a passage 38 in the cylinder head 19 to communicate with the combustion chamber 20 in a known manner. The gas reservoir 7 is partly formed as a cavity within the cylinder head 19 and partly in a detachable cover plate 17. The gas reservoir 7 is in continuous communication with the passage 38 by way of a passage 26.

The fuel injector unit 30 includes a nozzle 15 received in the passage 38 and a poppet valve 16 controlled by a solenoid unit 48. The solenoid unit 48 is cyclically energised in the known manner to open and close the valve 16 for the delivery of fuel and air to the combustion chamber 20.

A fuel metering device 14 cyclically delivers metered quantities of fuel through the fuel line 14A and needle 18 into the throat of a passage 42 which is in direct communication with the passage 26. The fuel passes into an annular cavity 25 surrounding a lower end 23 of a stem 22 of the valve 16, the annular cavity 25 being in direct communication with an upstream side of the head 24 of the valve 16. The passage 26 is laterally disposed in the nozzle 15 of the fuel injector 30 and provides a continuous free communication between the reservoir 7 in the cylinder head 19 and the annular cavity 25 in the fuel injector unit 30.

In the operation of an engine using the fuel and gas supplies above described, it is to be understood that the delivery of a metered quantity of fuel from the metering unit 14 through the needle 18 within the reservoir 7 into the cavity 25, is a separate operation from the opening of the valve 16 for the delivery of fuel entrained in gas from the reservoir 7 through the nozzle 15 to the engine combustion chamber 20. Assuming a starting position wherein the gas reservoir 7 is charged with gas previously received from the engine combustion chamber 20 and the piston of the associated cylinder is moving upwardly on a compression stroke of the engine, and a metered quantity of fuel has been delivered by the metering unit 14 via the passage 26 into the cavity 25 of the fuel injector 30, then, upon opening of the valve 16 at a point in the compression stroke when the cylinder pressure is substantially below the pressure in the reservoir 7, the metered quantity of fuel will be discharged through the nozzle 15 into the engine combustion chamber 20 entrained in the gas which will flow from the reservoir 7 through the passages 42 and 26 and hence, through the annular cavity 25 and out through the open nozzle 15.

After a relatively short interval of time, all of the metered quantity of fuel will be discharged through the nozzle 15 into the combustion chamber 20, and the continuing upward movement of the piston in the cylinder will provide a resultant rising pressure in the combustion chamber 20. A condition will be reached where the pressure in the combustion chamber 20 is greater than that in the reservoir 7 and a reverse direction of gas flow is achieved to replace the gas in the reservoir 7 discharged during the previous delivery of the fuel. This reverse flow of gas will raise the pressure of the gas in the reservoir 7 to a level substantially above the pressure in the combustion chamber 20 at the time of the next opening of the nozzle 15 to effect delivery of the fuel to the combustion chamber 20. The re-charged reservoir 7 is then in a condition to effect delivery of fuel to the combustion chamber 20 during the next engine cycle.

The fuel metering unit 14 may be of any known construction and one form of fuel metering unit particularly suitable for use in this environment is that disclosed in the applicant's co-pending PCT Patent Application No. PCT/AU92/00561, or International Patent Application No. WO 93/00502.

As disclosed in the above referenced prior specifications, the timing of the delivery of the fuel entrained in air to the combustion chamber 20 is effected by an electronic control unit (ECU) in the known manner, and as the metering of the fuel is independent of the delivery of the fuel to the combustion chamber 20, the timing of the delivery and the duration of the opening of the injector nozzle 15 can be varied without directly influencing the quantity of fuel delivered per cycle. Accordingly, the practice of the present invention of varying the timing of the opening and/or termination of the open period of the injector nozzle 15 in order to vary the pressure in the reservoir 7 can be practised without interfering with the fuel metering or injection operations. As previously stated, the variation of the timing of closing of the injector valve will control the pressure of the gas in the reservoir 7 such that the later the closing of the injector valve 16 in relation to the compression stroke of the engine, the higher will be the pressure in the reservoir 7.

The ECU customarily used in the management of a fuel injection system receives various input signals relating to operating conditions of the engine, one such input being the speed of rotation of the engine, and thus, it is a simple matter to include in the ECU a programme to control the idle speed or other selected speed range of operation of the engine by controlling the pressure of the gas in the reservoir 7 to actuate the appropriate mechanism, such as the pressure actuator 3 and hence control the rate of fuelling of the engine so as to maintain the engine speed at the desired level. For example, this could be activated by way of an appropriate look-up table or map or via adjustment by a PID algorithm.

Figure 3:
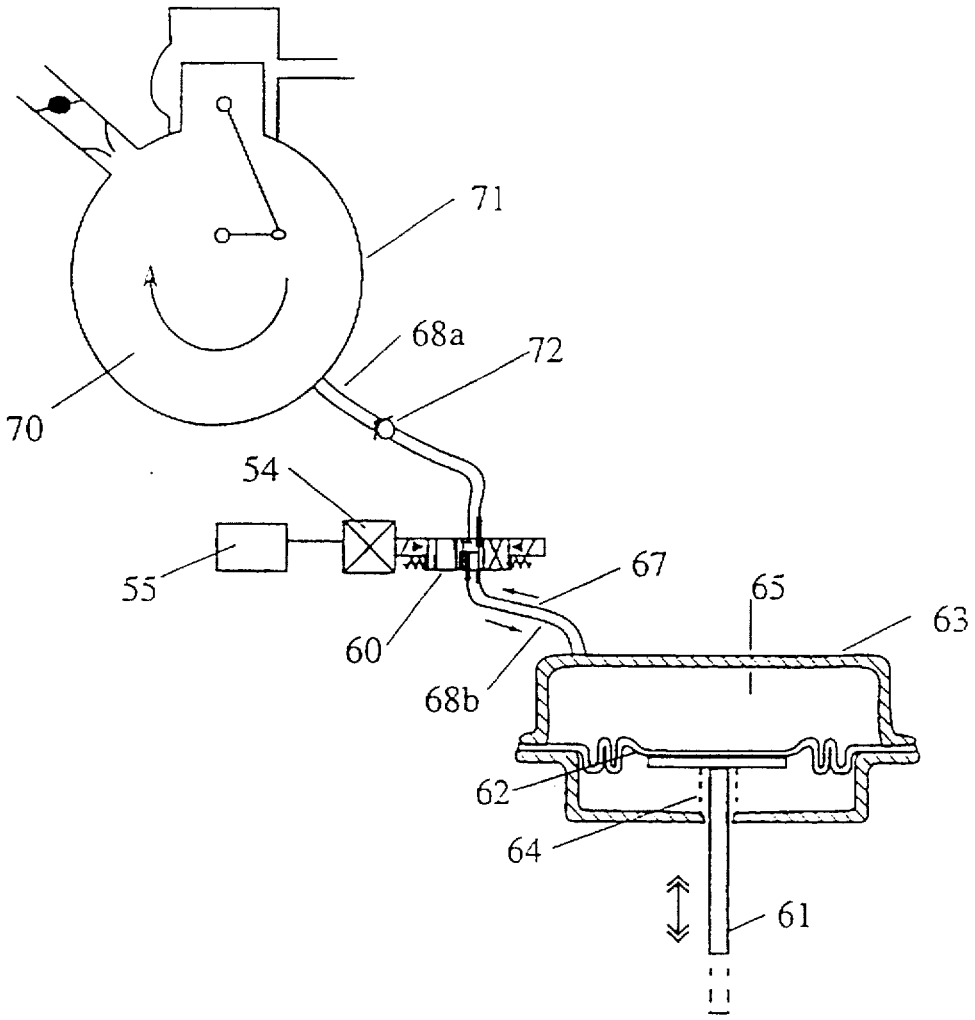
FIG. 3 is a schematic representation of an alternative embodiment of an engine speed controller.

Referring now to FIG. 3, there is illustrated diagrammatically an alternative form of the invention that is particularly applicable to two stroke cycle engines operating on the crankcase scavenge principle wherein the induced air in the crankcase is compressed prior to transfer from the crankcase to the combustion chamber. This type of engine configuration enables the present invention to be practised by use of the pressure of the air in the crankcase to actuate a mechanism, such as the pressure actuator 3 in FIG. 1, to control the engine speed, particularly during idle operation of the engine.

As shown in FIG. 3, the rod 61 is directly coupled to the diaphragm 62 forming part of the pressure actuator 63 in the identical manner to that previously described with reference to FIG. 1. The pressure in the pressure chamber 65 is controlled by the valve 60 which is operable to admit air to the pressure chamber 65 from the crankcase 70 of the two stroke cycle engine 71 via the air line 68*a*, valve 60 and air line 68*b*, and to control the bleeding of air from the pressure chamber 65 to atmosphere through the line 67, or to any other suitable location, such as into the air intake system of the engine 71, or finally to maintain the pressure in the pressure chamber 65 constant. Thus, for this particular embodiment, valve 60 is configured as a three position valve having two opened and one closed position, and in each of the two opened positions the valve 60 can enable a flow of air to or from the pressure chamber 65. This control system can be equally applicable to other gas pressure sources. That is, in this particular embodiment, positive crankcase pressure is used as a source of constant pressure, but other sources of constant pressure are also applicable.

For example, the reservoir 7 as described in relation to FIG. 1 may simply be utilised as a source of constant pressure and the fuel injector means 30 would not be operated to alter the end of nozzle opening time as previously described, but would operate as normal. The gas pressure in the reservoir 7 would then simply serve as a constant pressure source in place of the pressure in the engine crankcase 70.

Alternatively, the vacuum which is generated downstream from a throttle blade 69 in the air induction system of the engine 71 could equally be used as a substitute to positive crankcase pressure. Hence, a source of negative pressure or vacuum could be applied to the pressure chamber 65. Similarly, negative crankcase pressure in the same way as positive crankcase pressure may be used to provide a source of pressure. However, it is evident that in these latter two embodiments, the check valve 72 would need to be reversed and the spring 64 relocated in the pressure chamber 65 or be in the form of a tension spring. Further, a conventional compressor could also serve as a gas pressure source.

The valve 60 is actuated by a solenoid 54 or like device under the control of an ECU 55. The one way valve 72 provided in the air supply line 68*a* is arranged so that only above atmospheric pressures are supplied from the crankcase 70 into the line 68*b* and to the chamber 65.

In the event of the engine speed increasing beyond the required speed, the ECU will activate the valve 60 so as to close the discharge line 67 and open the entry line 68*b*, whereby compressed air will flow from the engine crankcase 70 into the pressure chamber 65 of the actuator 63 thereby deflecting the diaphragm 62 downwardly and effecting a similar movement to the rod 61. This movement of the rod 61 will in turn decrease the rate of fuel supply to the engine. Conversely, if the engine speed is too low, the ECU will operate the valve 60 so as to maintain the entry line 68*b* closed and to open the discharge line 67, thereby reducing the pressure in the pressure chamber 65 of the actuator 63 so that the diaphragm 62 will move upwardly under the action of the spring 64, thereby moving the rod 61 upwardly and increasing the fuelling rate to the engine. In the case where the engine speed is correct, both lines 68*b* and 67 are closed to maintain the existing pressure in the chamber 65.

The engine fuel control system as described with reference to FIG. 3 is particularly suitable for use in controlling the speed of crankcase scavenged two stroke cycle engines, but may be used in conjunction with engines having other sources of compressed air, such as a constant supply from a compressor or other suitable sources such as the gas reservoir 7 in FIG. 1 or the maximum pressure within the crankcase of a two stroke cycle engine. The valve 60 can be arranged to selectively apply a pressure gas source to chamber 65 of the pressure actuator 63, to vent the chamber 65 to atmosphere, or to isolate the chamber 65 from both the pressure gas supply and atmosphere. In the latter position, the diaphragm 62 in the pressure actuator 63 is held in a fixed position as also is the rod 61. Each of the respective positions of the valve 60 are selectable by the ECU dependent upon the actual speed of the engine relative to a preset or desired speed of operation of the engine, such as idle speed.

In relation to the embodiment shown in FIG. 3, a modification thereof is to dispense with the control valve 60 and provide a fixed diameter bleed orifice in the pressure chamber 65 of the actuator 63. The orifice is dimensioned to provide a pressure variation in the pressure chamber 65 proportional to the engine speed, thus as the engine speed increases the pressure on the diaphragm increases and as the engine speed decreases, the pressure on the diaphragm decreases. Thus the movement of the rod 61 and hence the fuelling rate is controlled to maintain the required engine speed.

Also in relation to the embodiment shown in FIG. 3, the gas supplied to the actuator 63 can be from an external source, rather than from the engine crankcase 70 and the supply can be controlled by the valve 60 such as by varying the degree of opening of the valve, the frequency of opening, the total duration of opening or any combination thereof.

Where the invention is applied to a multi-cylinder two stroke cycle engine, the gas supplied to the fuelling rate control actuator 63 may be from only one or some of the multiple number of crankcases of the engine.

Figure 4:
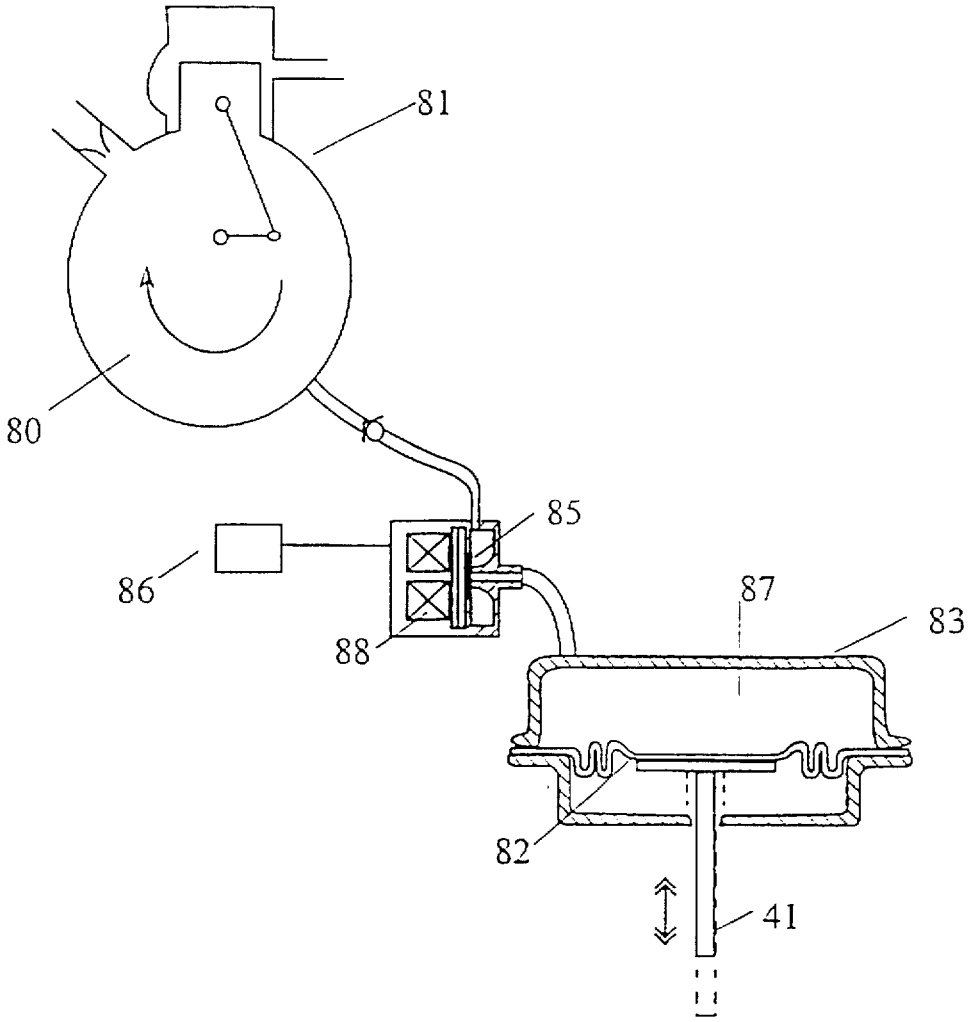
FIG. 4 is a schematic representation of yet a further alternative embodiment of an engine speed controller.

Referring now to FIG. 4, there is illustrated a modified form of the engine control system as shown in FIG. 3. The two stroke cycle crankcase scavenged engine 81 and the actuator 83 are the same as the corresponding components 71 and 63 in FIG. 3 and will not be further described hereinafter. The difference resides in that the multi position valve 60 in FIG. 3 is replaced by a single valve element 85 actuated by a solenoid 88, under the control of an ECU 86.

It is necessary, in order to understand this embodiment, to appreciate that in a crankcase scavenged two stroke cycle engine, the timing of the variation of the pressure in the crankcase with respect to the engine cylinder cycle is, broadly speaking, independent of engine speed. The only main difference is the real time frequency of the pressure cycle. There may also be a minor variation of the peak maximum and minimum pressures, however, this does not effect the operation of the engine speed control means to a significant degree. Accordingly, the pressure in the crankcase 80 can be used as a reliable source of energy to actuate a device such as the actuator 83 that regulates the fuel supply to the engine 81.

The ECU 86 receives appropriate inputs indicative of the required engine fuelling rate and determines the required position of the diaphragm 82 to achieve that fuelling rate. The ECU 86 then energises the solenoid 88 to open the valve 85 during the appropriate portion of the cylinder cycle to apply pressure to the pressure chamber 87 to move the diaphragm 82 to the position corresponding to the required fuelling rate.

If the diaphragm 82 is to be moved downward as seen in FIG. 4 the valve 85 is opened during a period of high crankcase pressure in the operating cycle of the engine 81. If the diaphragm 82 is to be moved upward as seen in FIG. 4, the valve 85 is opened during the low pressure period of the crankcase cycle, this typically being the period where the crankcase pressure is below atmospheric pressure. If the diaphragm 82 is to be held in a fixed position to provide a steady fuelling rate, the valve 85 is held closed.

A further embodiment of the present invention may utilise as its force generating pressure the pressure which exists in the engine induction system, particularly that pressure present downstream of the throttle blade and upstream of the intake reed valves of the induction system. This source of pressure which varies in relation to the engine speed and/or load may be used to control an actuator like that shown at 3 in FIG. 1.

Typically, during idle or low speed operation, the throttle blade in the induction system is essentially closed, and so, a vacuum is generated upstream of the reed valves and downstream of the throttle blade. For a set position of the throttle blade, this vacuum varies with respect to engine speed in that it becomes more negative as the engine speed increases and vice versa. Accordingly, this variable negative pressure can be used to control the movement of a diaphragm like that as shown at 2 in FIG. 1.

For example, if it is desired to idle at a certain speed, but the actual speed of the engine is too high, the pressure in the induction system will be less than that which would correspond to the desired idle speed (ie: vacuum is greater than that desired). This pressure can accordingly be used to actuate the diaphragm 2 via a conduit like that shown at 8 in FIG. 1 such that the appropriate control of a rod like 1 in FIG. 1 is actuated to decrease the fuelling rate to the engine. Conversely, a lower idle speed than desired would result in a greater pressure (ie: vacuum is lower than that desired) in the induction system which could be used to actuate the rod 1 appropriately to increase the fuelling rate to the engine.

Obviously, the particular arrangement of the actuator 3, pressure chambers 5 and 6 and conduit 8 as shown in FIG. 1 would be arranged such that an increase or decrease in the vacuum in the induction system gave the desired control of the fuelling rate to the engine.

Figure 5:
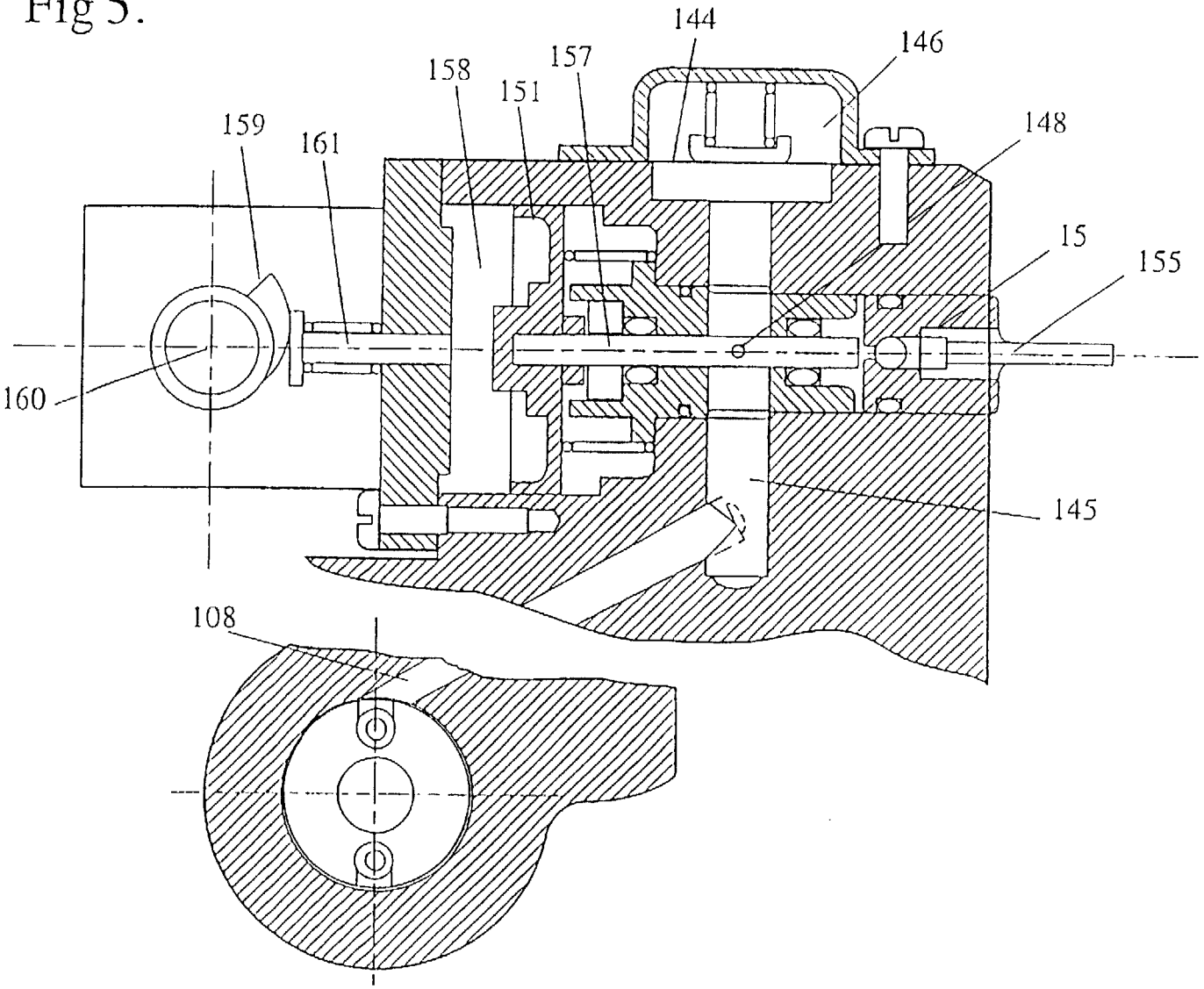
FIG. 5 is a sectional view of a fuel metering apparatus to which the present invention can be applied.

FIG. 5 illustrates a fuel metering apparatus to which the present invention may be applied and which is described in more detail in the applicant's PCT Patent Application No. PCT/AU92/00516. The reference numerals as shown in FIG. 5 are based on the reference numerals used in the PCT application plus 100, but a number of the components identified by reference numerals in the PCT application will not be described in this specification, but are appropriately described in the above referred to patent application. The disclosure of PCT Patent Application No. PCT/AU92/00516 is incorporated herein by reference.

The portion of the mechanism shown in FIG. 5 directly related to the present invention is the piston 151, connected to the metering rod 147, and the cam 159 which co-operates with the piston stop 161 to control the stroke of the piston 151, and hence the stroke of the metering rod 147. More particularly, the piston 151 reciprocates in the cylinder 158 in response to the cyclic application of fluid pressure in the cylinder 158. The application of this fluid pressure will displace the piston 151, and the fuel metering rod 147 connected thereto, to the right as seen in FIG. 5 and in doing so will deliver fuel through the duct 155 to a fuel injector (not shown). It will be appreciated that by varying the stroke of the piston 151 and hence the stroke of the metering rod 147, the quantity of fuel delivered each stroke of the metering rod 147 can be varied in accordance with the fuel requirements of the engine.

The variation in the metered quantity of fuel delivered is achieved by rotation of the cam 159 on the axis 160 thereof, the cam 159 co-operating with the piston stop 161 which controls the return position of the piston 151 in the cylinder 158. Thus as the piston stop 161 is moved to the right as seen in FIG. 5, the stroke of the fuel metering rod 147 is decreased and consequently the quantity of fuel delivered from the fuel metering chamber each stroke is correspondingly reduced.

Figure 6:
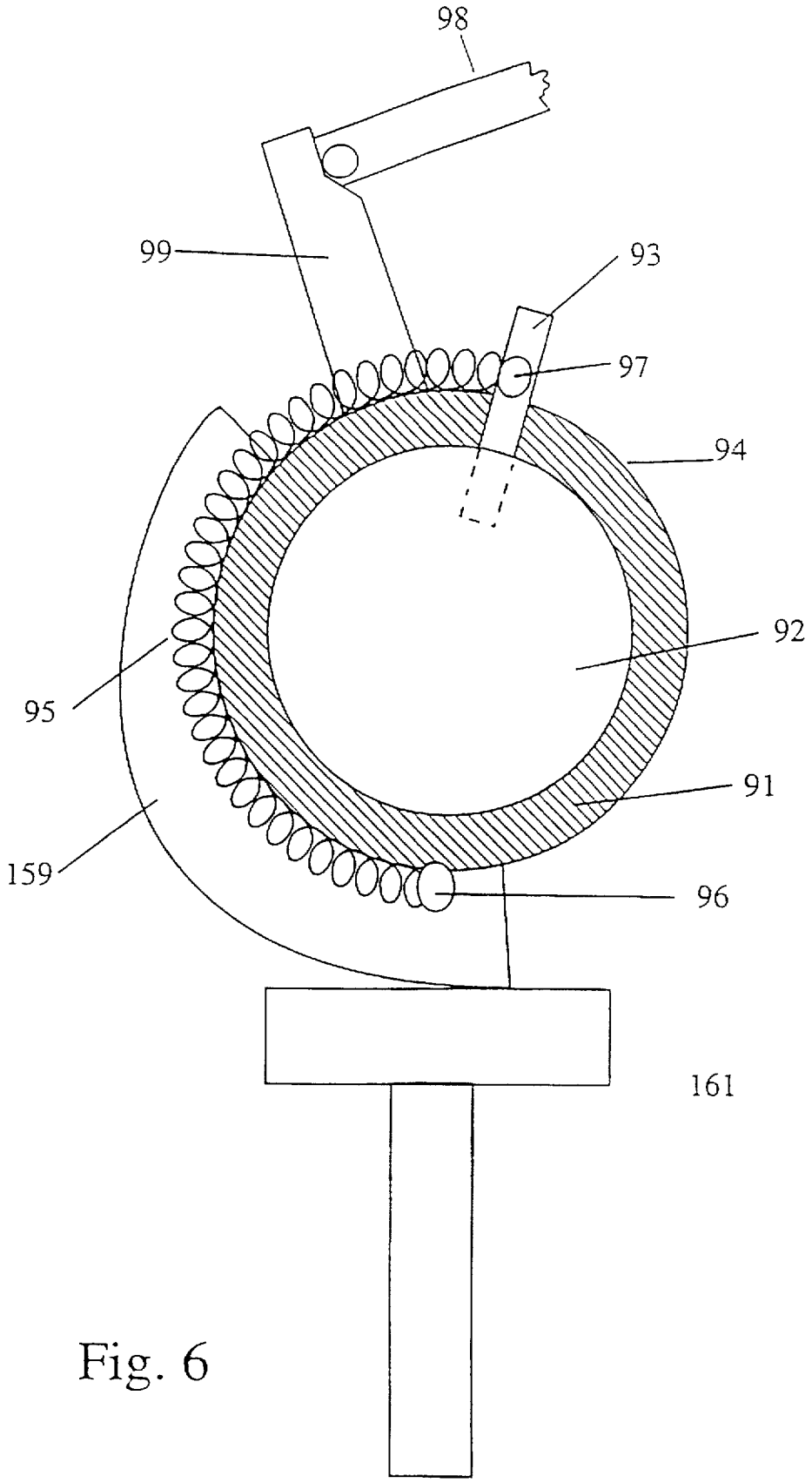
FIG. 6 illustrates a manner of applying the invention to the fuel metering apparatus as shown in FIG. 4.

Referring now to FIG. 6, there is illustrated the details of the construction of the cam 159 and the actuation thereof by the rod 1, 61 or 41 as shown in FIGS. 1, 3 or 4 respectively. The cam 159 is integral with the sleeve 91 which is rotatably mounted on the shaft 92. The drive pin 93 is rigidly secured to the shaft 92 and extends through the slot 94 formed in the sleeve 91. The coil spring 95 is anchored to the cam 159 at 96 and to the pin 93 at 97. Thus, the spring 95 holds the sleeve 91 with the forward end of the slot 94 against the arm 93. As the shaft 92 and arm 93 rotate in the anti clockwise direction, the sleeve 91 and cam 159 are also caused to move in that direction in unison with the shaft 92. The shaft 92 is rotated in response to the normal speed and load control device of the engine so that the fuel supply is controlled in proportion to the engine load and speed.

The arm 99 is rigidly attached to the sleeve 91 and the rod 98 is the equivalent of rod 1, 61 or 41 as shown in FIGS. 1, 3 or 4 respectively of the drawings which is axially moved in response to the movement of the diaphragm 2, 62, 82 in the actuating means 3, 63, 83. Thus, when the engine is at idle or low speed, and the actuator 3, 63 or 83 is functioning, movement of the rod 98 to the left as seen in FIG. 6 will cause the arm 99, sleeve 91 and cam 159 to rotate anticlockwise in unison relative to the shaft 92 to increase the fuel supply to the engine by increasing the stroke of the fuel metering rod 147 by raising the stop 161. Upon movement of the rod 98 to the right as seen in FIG. 6, the spring 96 will cause the arm 99, sleeve 91 and cam 159 to rotate clockwise until the forward end of the slot 94 again abuts the arm 93.

Thus, it will be seen that the actuating means 3, 63, 83 as described with reference to FIGS. 1, 3 or 4 may be used to control the rate of fuel supply to the engine when the normal engine speed control mechanism and the shaft 92 attached thereto is stationary.

The claims defining the invention are as follows:

1. A method of operating an internal combustion engine having a fuel injection system comprising the steps of injecting fuel entrained in a compressed gas to in engine combustion chamber, electronically managing fluid pressure available from a source associated with the operation of the engine in at least part of the load operating range of the engine, applying said managed pressure as an energy source to power a control device to control at least one operating parameter of the engine, wherein said step of electronically managing fluid pressure comprises the step of controlling said fluid pressure using an electronic control unit.

2. A method as claimed in claim 1 wherein said operating parameter is the rate of supply of fuel to the engine over at least part of the engine load operating range.

3. A method as claimed in claim 1 wherein said operating parameter is the engine ignition timing over at least part of the engine load operating range.

4. A method as claimed in claim 1 wherein said operating parameter is the timing of injection of fuel to respective combustion chambers of the engine.

5. A method as claimed in claim 1 wherein the fluid pressure source is an air induction system through which air is induced to flow to one or more combustion chambers of the engine.

6. A method as claimed in claim 1 further comprising the step of delivering fuel entrained in the compressed gas to one or more combustion chambers of the engine, wherein said fluid pressure source is a compressed gas source used to effect said delivery of fuel to the combustion chamber or chambers.

7. A method as claimed in claim 6 wherein the step of delivering fuel comprises delivering fuel directly to each combustion chamber of the engine through individual injectors, and the compressed gas source supplies compressed gas to each said individual injector.

8. A method as claimed in claim 6 wherein the gas is provided by a compressor.

9. A method as claimed in claim 1, wherein said fluid pressure source comprises an air compressor to deliver compressed air to a fuel injection system, and wherein said method further comprises the step of supplying said fluid pressure from the intake side of said compressor.

10. A method as claimed in claim 1 wherein said fluid pressure source available from the operation of the engine is a source wherein the pressure of the fluid varies in response to variations of speed or load of the engine.

11. A method as claimed in claim 1 wherein said fluid pressure source available from the operation of the engine is a source wherein the fluid pressure cycles between high and low levels during each cycle of the engine and said fluid pressure is applied to effect said control during a selected part of said cycle.

12. A method as claimed in claim 11 wherein said fluid pressure source provides fluid at a selected period in said cycle to achieve a substantially steady pressure fluid supply.

13. A method as claimed in claim 1 wherein said control means is a pressure actuator including a diaphragm device.

14. A method as claimed in claim 13, wherein mechanical output from said pressure actuator is substantially linear and actuates a fuel control device.

15. A method of controlling the speed of a fuel injected internal combustion engine comprising the steps of injecting fuel entrained in a compressed gas into an engine combustion chamber, controlling a fuelling rate by controlling a physical movement of a fuel control member at least when the engine is idling or operating in a selected speed range, and electronically managing a pressure of said gas to control said movement of said fuel control member in response to the pressure of said gas acting as an energy source for said fuel control member.

16. A method as claimed in claim 15 further comprising the step of controlling the engine speed independently of said gas pressure when the engine is not idling or is operating outside said selected speed range.

17. A method as claimed in claim 16 further comprising the step of applying said gas pressure to control said engine speed when the engine is operating in a second speed range outside of said selected speed range.

18. A method as claimed in claim 17 further comprising the step of deriving said compressed gas from a compressor driven by said engine.

19. A method as claimed in claim 15 wherein the compressed gas source is derived from the operation of the engine.

20. A method as claimed in claim 19 further comprising the step of using compressed gas derived from the compression of gas in at least one combustion chamber of said engine as the compressed gas source.

21. A method as claimed in claim 15 further comprising the step of supplying from at least one combustion chamber of the engine said gas in which the fuel is entrained.

22. A method as claimed in claim 21 further comprising the step of controlling the pressure of said gas by controlling the timing of the supply of gas from the combustion chamber in the cycle thereof.

23. An internal combustion engine having a fuel injection system to deliver fuel entrained in a compressed gas to the engine combustion chamber, comprising a control device operable in response to changes in fluid pressure, the control of said control device being effected by an electronic control unit, and means for electronically managing and providing said fluid pressure as an energy source to actuate said control device, wherein said fluid pressure is available from a source associated with the operation of the engine.

24. The internal combustion engine according to claim 23 wherein said control device controls the rate of supply of fuel to the engine over at least part of the speed or load operating range of the engine.

25. The internal combustion engine according to claim 23 wherein said control device controls the timing of engine ignition at least over part of the speed and load operating range of the engine.

26. The internal combustion engine according to claim 23 wherein said control device controls the timing of injection of fuel to the engine at least over part of the speed or load range of the engine.

27. The internal combustion engine according to claim 26 wherein the engine has one or more combustion chambers and fuel is supplied to respective combustion chambers entrained in a compressed gas, said means operable to provide fluid pressure being the means to provide said compressed gas.

28. The internal combustion engine according to claim 27 wherein the compressed gas is supplied from one or more of the engine combustion chambers.

* * * * *